US005660203A

United States Patent [19]

Gnauert et al.

[11] Patent Number: 5,660,203

[45] Date of Patent: Aug. 26, 1997

[54] DECK-MOUNT MIXING-FAUCET ASSEMBLY

[75] Inventors: Werner Gnauert, Iserlohn; Stefan Steinhoff, Sundern, both of Germany

[73] Assignee: Friedrich Grohe AG, Hemer, Germany

[21] Appl. No.: 588,080

[22] Filed: Jan. 18, 1996

[30] Foreign Application Priority Data

Jan. 24, 1995 [DE] Germany ..... 195 02 075.8

[51] Int. Cl.[6] ..... E03C 1/04

[52] U.S. Cl. ..... 137/359; 4/677; 137/801

[58] Field of Search ..... 4/677; 137/359, 137/801

[56] References Cited

U.S. PATENT DOCUMENTS 5,349,987 9/1994 Shieh ..... 137/801

5,361,431 11/1994 Frier et al. ..... 137/218 X 5,515,882 5/1996 Hennis ..... 137/359

OTHER PUBLICATIONS

International Publication No. WO 94/24379 Published 27 Oct. 1994.

*Primary Examiner*—Gerald A. Michalsky

*Attorney, Agent, or Firm*—Herbert Dubno; Andrew Wilford

[57] ABSTRACT

A mixing faucet adapted to be mounted on a support body having an outside face, an inside face, and a hole extending between the faces has a faucet body adapted to sit on the outside face over the hole, a mixing valve in the body having hot- and cold-water inlet ports and a mixed-water outlet port, and a rigid tubular stem fixed to the body, extending through the hole, formed with a passage connected to one of the ports, having at the outer face an external screwthread, and having an outer end. At least one conduit extends through the hole and is connected to another of the ports. A nut is threaded onto the external screwthread of the stem and bears against the inside face.

4 Claims, 2 Drawing Sheets

DECK-MOUNT MIXING-FAUCET ASSEMBLY

FIELD OF THE INVENTION

The present invention relates to a faucet. More particularly this invention concerns a deck-mount mixing faucet.

BACKGROUND OF THE INVENTION

A standard mixing faucet as described in German patent 3,330,156 has a faucet body that is mounted on the outside face of a support deck over a throughgoing hole therein and that is secured to this deck by a threaded stem extending through the hole and bearing on the opposite inside face of the deck. In addition hot- and cold-water feed lines extend through the hole to a valve housed in the faucet body and having hot- and cold-water inlet ports and a mixed-water outlet port. In a faucet with a removable spray head as described in German utility model 1,657,933, a mixed-water hose extends from the valve outlet port down through the hole where it forms a loop and then back up through the hole to where it is connected to the sprayer head.

Thus it is possible that the two supply lines, two different sections of the mixed-water hose, and the securing stem—five different elements—all have to go through the same hole in the deck. This is clearly a lot of structure to fit in a limited space. To accommodate this structure it is frequently made as small as possible, which can give problems with respect to strength and long-term service, and in any circumstances presents a considerable installation problem.

OBJECTS OF THE INVENTION

It is therefore an object of the present invention to provide an improved deck-mount mixer faucet.

Another object is the provision of such an improved deck-mount mixer faucet which overcomes the above-given disadvantages, that is which can easily be mounted over a single hole in a support.

SUMMARY OF THE INVENTION

A mixing faucet adapted to be mounted on a support body having an outside face, an inside face, and a hole extending between the faces has according to the invention a faucet body adapted to sit on the outside face over the hole, a mixing valve in the body having hot- and cold-water inlet ports and a mixed-water outlet port, and a rigid tubular stem fixed to the body, extending through the hole, formed with a passage connected to one of the ports, having at the outer face an external screwthread, and having an outer end. At least one conduit extends through the hole and is connected to another of the ports. A nut is threaded onto the external screwthread of the stem and bearing against the inside face.

Since the mounting stem serves double duty, conducting a fluid and securing the housing to the support, there is a considerable saving in structure that must pass through the hole in the support, three rather than five elements traversing the hole. In fact such an arrangement leaves enough room that the faucet body can have simple sockets for the ends of the supply lines, greatly simplifying the installation.

According to a feature of this invention the faucet body is formed with a stepped bore formed in turn with a small-diameter threaded portion and a larger-diameter smooth portion. The stem is formed with a threaded end fitting complementarily in the small-diameter threaded portion and an outwardly open annular groove offset from the threaded end and holding a seal ring radially outwardly engaging the smooth larger-diameter portion of the bore. This makes for a very solid mounting of the faucet body on the outside support face.

The outer end according to the invention is provided with a plumbing connector in the form of a simple snap- or screw-type element that can easily be connected to a mixed-water hose or supply line.

The passage of the stem in accordance with this invention is connected to the outlet port, although it could of course be connected to either of the inlet ports. When connected to the outlet port the faucet further has according to the invention a flexible hose having one end secured to the plumbing connector, an opposite end provided with an outlet head seatable Ion the faucet body, and an intermediate portion extending back up through the hole from the connector.

According to another feature of this invention when use is made of the housing as a pressure-free overflow-type warm-water device the pressurized cold water is supplied to the valve via the tubular stem.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
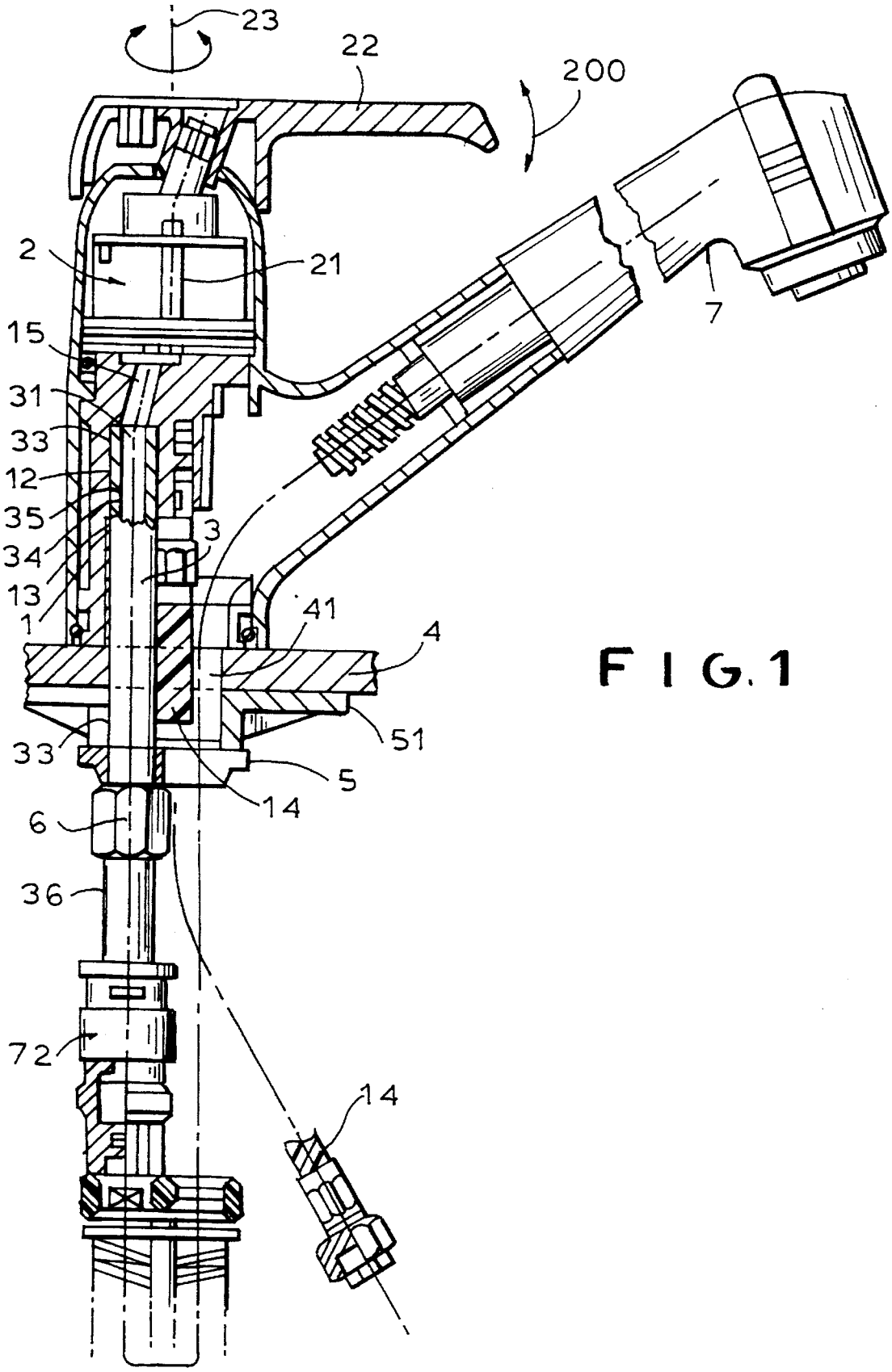
FIG. 1 is a vertical section through the faucet assembly according to the invention.

As seen in the drawing, a mixing faucet according to this invention basically comprises a cast faucet body 1 to which is fitted a standard valve cartridge 2 and from which extends a brass or bronze mounting stem 3 through a deck 4. Underneath the deck 4 a washer 5 and nut 6 secure the housing 1 in place. A removable sprayer head 7 is carried on the housing 1.

More particularly, the cartridge 2 is secured atop the body 1 by means of two screws 21 and is connected to a handle 22 which can be twisted about an axis 23 to adjust the temperature of the outgoing water and tipped as indicated by arrow 220 to control the flow rate, as is standard. Mixed water flows out of the valve cartridge 21 through a passage 15 formed in the body 1. Other unillustrated passages in the body 1 are connected to pressurized hot- and cold-water supply lines 14 that extend like the stem 3 through a hole 41 in the deck 4.

The stem 3 is tubular and has a longitudinally throughgoing passage 31 that receives flow from the housing passage 15. The housing 1 is formed with a stepped bore having a small-diameter upper threaded portion 12 and a smooth-walled larger-diameter lower portion 13. The stem 3 is formed with a radially outwardly open groove 34 holding an O-ring 35 and offset therefrom has a small-diameter upper end portion 33 formed with a screwthread that mates with that of the upper portion 12 and otherwise is of about the same diameter as the lower portion 13 to form a snug fit therein, with the O-ring 35 engaging the larger bore portion 13 tightly.

The lower region of the tubular stem 3 is formed with an external M 14×1.5 screwthread 36 on which the nut 6 is engaged so it can press the washer 5 and a mounting plate 51 against the inside face of the deck 4 formed with the hole 41 through which the stem 3 passes. The extreme lower end of the stem 3 has a plug-type plumbing connector 32 adapted to fit one end fitting 72 of a hose 71 whose opposite end is fitted in the sprayer 7 that fits in a hollow arm 11 of the housing 1.

Figure 2:
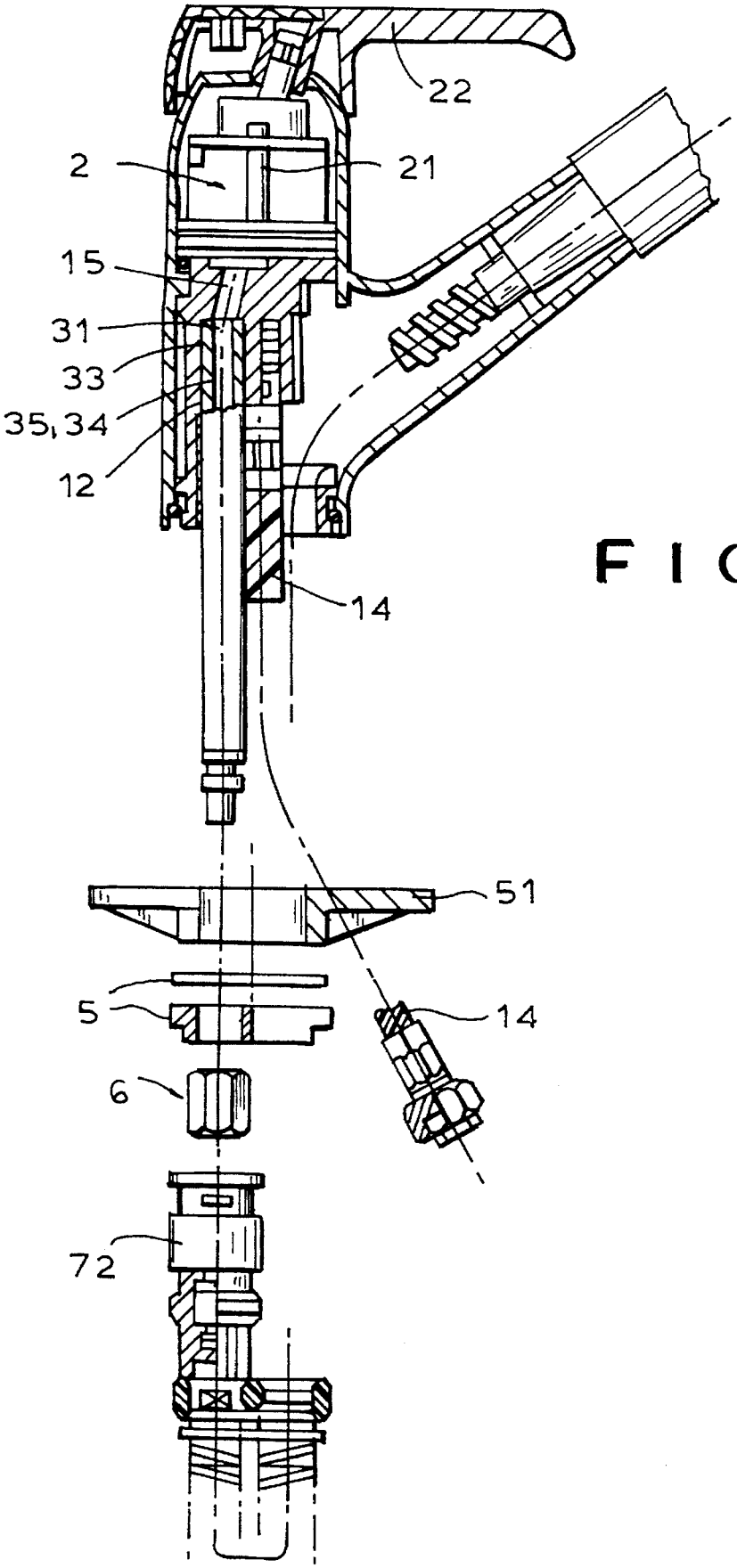
FIG. 2 is an exploded view of the faucet of FIG. 1.

This system is installed by fitting a subassembly comprised of the body 1, stem 3, and supply lies 14 through the hole 41, after if necessary removing the connector 72, washers 5, and nut 6 as shown in FIG. 2. Then the body 1 with the stem 3 and the two lines 14 and the hose 71 are threaded through the hole 41. The plate 51, washers 5, and nut 6 are then installed, and the connector 72 is snapped on the end 32. Connections are made to the lines 14 and the installation is complete.

We claim:

1. A mixing faucet adapted to be mounted on a support body having an outside face, an inside face, and a hole extending between the faces, the faucet comprising:

a faucet body adapted to sit on the outside face over the hole and formed with a stepped bore having
a small-diameter threaded portion, and
a larger-diameter smooth portion;

a mixing valve in the body having hot- and cold-water inlet ports and a mixed-water outlet port;

a rigid tubular stem fixed in the bore, extending through the hole, and formed with
a passage connected to one of the ports,
a small-diameter threaded inner end fitting complementarily in the small-diameter threaded portion,
an outwardly open annular groove at the smooth portion,
an external screwthread at the inside face, and
an outer end;

a seal ring seated in the groove and radially outwardly engaging the larger-diameter portion of the bore;

at least one conduit extending through the hole and connected to another of the ports; and a nut threaded onto the external screwthread of the stem and bearing against the inside face.

2. The mixing faucet defined in claim 1 wherein the outer end is provided with a plumbing connector.

3. The mixing faucet defined in claim 2 wherein the passage of the stem is connected to the outlet port, the faucet further comprising a flexible hose having one end secured to the plumbing connector, an opposite end provided with an outlet head seatable on the faucet body, and an intermediate portion extending back up through the hole from the connector.

4. The mixing faucet defined in claim 1 wherein the stem is made of brass or bronze.

* * * * *